United States Patent [19]

Saueressig

[11] Patent Number: 4,685,393

[45] Date of Patent: Aug. 11, 1987

[54] ROTOGRAVURE CYLINDER COMPRISING A CORE AND A SHELL DETACHABLY JOINED THERETO

[75] Inventor: Karl Saueressig, Vreden, Fed. Rep. of Germany

[73] Assignee: Saueressig & Co., Vreden, Fed. Rep. of Germany

[21] Appl. No.: 838,679

[22] Filed: Mar. 12, 1986

[30] Foreign Application Priority Data

Mar. 29, 1985 [DE] Fed. Rep. of Germany ..... 3511530
Feb. 20, 1986 [EP] European Pat. Off. ..... 86102237.4

[51] Int. Cl.[4] ..... B41F 13/10
[52] U.S. Cl. ..... 101/375
[58] Field of Search ..... 101/152, 153, 170, 395, 101/375, 376, 378; 204/17, 25; 29/113 R, 132

[56] References Cited

U.S. PATENT DOCUMENTS 3,253,323 5/1966 Saueressig ..... 101/376
4,150,622 4/1979 Stollenwerk ..... 29/113 R
4,197,798 4/1980 Bardin ..... 101/153
4,301,727 11/1981 Bardin ..... 101/153
4,386,566 6/1983 Moss ..... 101/375

FOREIGN PATENT DOCUMENTS 0053791 6/1982 European Pat. Off. ..... 101/375

*Primary Examiner*—J. Reed Fisher
*Attorney, Agent, or Firm*—Felfe & Lynch

[57] ABSTRACT

Disclosed is a rotogravure cylinder having a core and a sleeve detachably joined to the core, with the core being substantially solid and formed of a metal. The core is provided with passages for passing compressed air to the outer surface thereof. The sleeve is adapted to be fitted onto the core and removed therefrom with the aid of an air cushion produced by the compressed air. The sleeve consists of at least three concentric layers. The inner layer is formed of a material of low elasticity, and is slightly compressible. The center layer is formed of a rigid and inherently stable material, the inner and/or the center layer each may be varied in their thickness. The outer layer comprises a copper layer.

18 Claims, 1 Drawing Figure

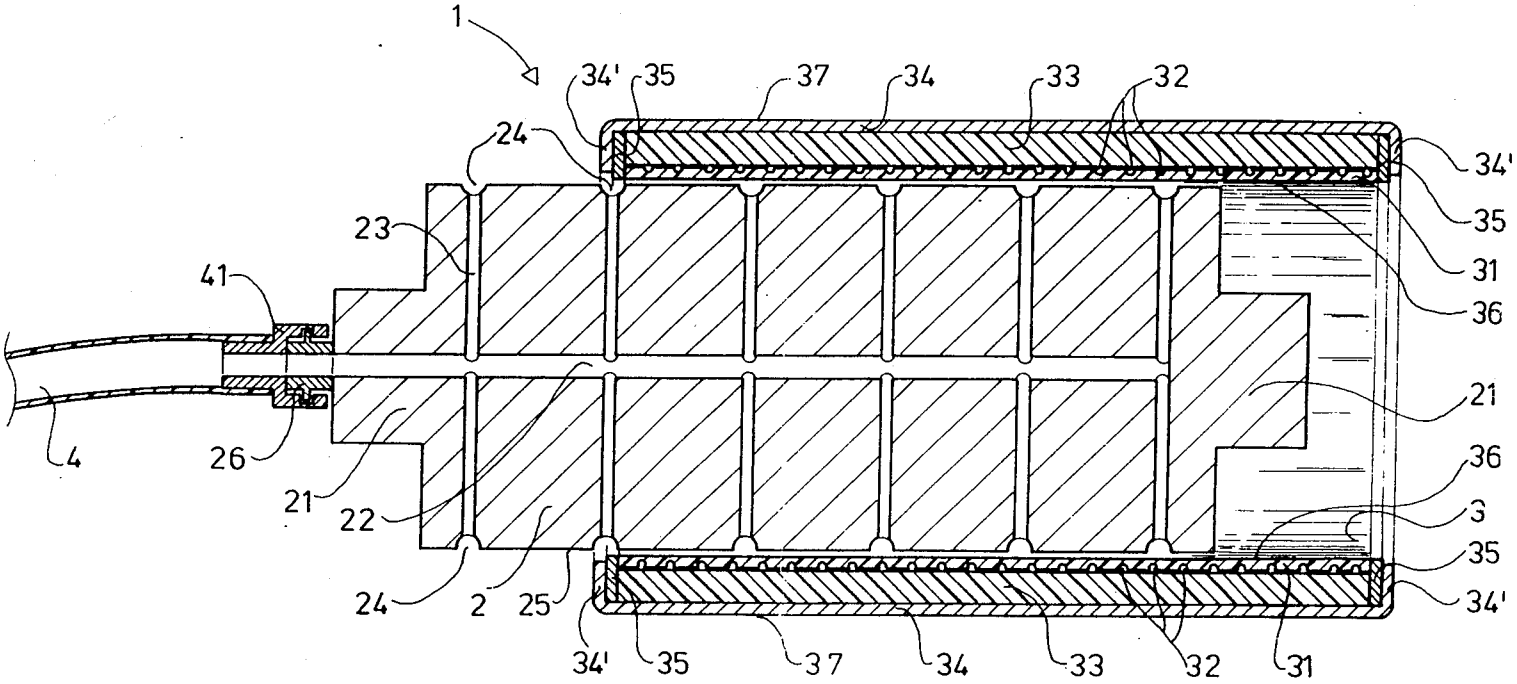
34'
35
31
36
21
36
3
35
34'
31
32
33
34
37
35
34'
1
24
23
41
4
26
21
22
24
2
25
34'
35
37
34
33
32

ROTOGRAVURE CYLINDER COMPRISING A CORE AND A SHELL DETACHABLY JOINED THERETO

The present invention relates to a rotogravure cylinder, comprising a core and a sleeve detachably joined to the core, with the core being substantially solid and formed of a metal and provided with passages for passing compressed air to the outer surface thereof, and with the sleeve being adapted to be fitted onto the core and removed therefrom with the aid of an air cushion produced by the compressed air.

Rotogravure cylinders of the kind as outlined above are known per so to the expert in the field of printing machines from developments made by the relevant industry. Such cylinders are intended to make easier the handling of the printing cylinders and reduce transportation costs, by leaving the cores in the printing house and transporting only the shells without the cores between the engraving shop and the printing house.

In practice, however, printing cylinders of this type could not yet succeed. The reason for this is the still poor quality of the printing (rotogravure) cylinders and of the printing result obtained by such printing cylinders. The reasons for the poor printing quality must be seen in the configuration of the sleeve. Conventional sleeves are formed to have a certain degree of elasticity so that they are expansible under the action of compressed air. To this end, there are used, for example, elastic or resilient metals, such as nickel, as the sleeve material underneath the necessarily provided outer copper layer. In order to provide for an elasticity (resilience) of the shell still sufficient for the requisite expanison, the shell must be formed with a relatively small wall thickness. This, again, has the consequence that the outer copper layer is liable to peel from the substrate in use, whereby the printing cylinder is rendered unusable. Besides, there is a risk that the thin-walled sleeve are damaged during transportation or handling.

The above already implies the next drawback which resides in that, in spite of the separability of core and sleeve, the number of cores of different dimensions which must be kept in store, cannot, or not significantly, be reduced. In the conventional sleeve construction, the margin of variation for the outer diameter of the sleeve with a fixed inner diameter thereof, i.e. with a fixed outer diameter of the core, is extremely limited.

Accordingly, it is the object of the invention to provide a rotogravure cylinder of the type as outlined above, which cylinder avoids the above-discussed drawbacks and which, in particular, is capable of providing a proper printing result equivalent to that of an integral printing cylinder, which cylinder permits to considerably reduce the number of core sizes to be kept on store, and in which the sleeve has a stability positively sufficient for printing operations and transportation.

According to the invention, this object is solved in that the sleeve consists of at least three concentric layers,

- that the inner layer is formed of a material of low elasticitiy, and the inner layer is slightly compressible, that the center layer is formed of a rigid and inherently stable material,
- that the inner and/or the center layer each may be varied in their thickness, and
- that the outer layer comprises a copper layer.

A rotogravure cylinder of this type offers the advantage that the inner diameter of the sleeve is adapted to be increased to a degree sufficient to allow the sleeve to be fitted onto the core and to remove it therefrom, while, at the same time, the outer diameter and the outer configuration of the sleeve are absolutely constant and stable. The sturdy sleeve provides for exact concentricity during the printing operation and, thus for a high quality of printing. Since the inner layer is of low elasticity only and slightly compressible, relative movement between the core and the sleeve under the pressing forces normally applied in the printing process cannot occur. Owing to the possible variation of the thickness of both the inner layer and the center layer of the sleeve, sleeves of the most varied outer diameters or circumferential lengths with identical inner diameters may be manufactured. Accordingly, the number of core diameters required may be drastically reduced with a relatively wide variation width or graduation. Owing to its inherent stability, the sleeve of the rotogravure cylinder according to the invention is protected to maximum degree against deformation and damage during handling and transportation, without any expensive precautional measures being required to this end.

A preferred material for the inner layer of the sleeve is rubber, because this material, on the one hand, lends itself to be freely adjusted (set) with the requisite elasticity, and on the other hand, may be processed with a sufficient degree of exactness or precision.

Actually, a porous material could be used as the inner material (layer) of the sleeve to ensure compressibility; however, this involves the drawback that the total volume of the pore spaces and therefore the degree of compressibility cannot be determined exactly and cannot be distributed uniformly throughout the material. Therefore, according to a preferable feature it is provided that the material of the inner layer of the sleeve is free from pores, and that the outer surface of the material is provided with recesses permitting to enlarge the inner diameter of the inner layer. Thus, the degree of compressibility of the inner layer, and therefore the magnitude of expansibility of the inner diameter of the sleeve, can be defined exactly by means of number, shape, depth and positioned of the recesses. The provision of the recesses in the outer side of the inner layer yields a beneficially smooth inner surface of the sleeve, and this feature greatly facilitates the fitting and removing steps while avoiding damage to the inner layer.

The rubber forming the inner layer should have a Shore hardness of between 70 and 110, preferably between 85 and 90. According to practical tests, this permits to obtain an increase of inner diameter of about 0.1 mm with recesses formed in the material to the amount of about 5% of the total volume of the inner layer, with a material thickness of about 5 mm and under an air pressure of about 6 bar (atmospheres), and this expanison is enough for smooth fitting on and removal of the sleeve. On the other hand, when compressed air was not applied, the sleeve could not be removed from the core even under a stripping force of 1500 kp (kg), as tests have shown.

A particularly favorable and advantageous form of the recesses in the outer surface of the inner layer of the sleeve is constituted by at least one flat groove extending helically around the sleeve. This configuration provides a particularly high shear stability (strength) of the inner layer since the outer surface thereof is not divided into separate segments, but has a circumferentially continuous configuration. In addition, these recesses may be formed easily and precisely on, for example, a lathe.

In order to ensure precise dimensions of the inner diameter, exact roundness and concentricity of the sleeve, it is contemplated that at least the inner layer of the sleeve, including the recess, has been formed on a master core having the diameter of the core receiving the sleeve for the printing operation. In order to vary the outer diameter of the sleeve with a constant core diameter, the thickness of the inner layer of the sleeve is variable, inter alia. Preferably, the thickness of the inner layer of the sleeve is between 3 and 30 mm. This thickness range allows for both sufficient increase of the inner diameter and adequate stability and exactness of the printing cylinder.

A preferred material for the center layer of the sleeve, which is responsible for securing the necessary stability, is a fiberglass-reinforced plastics material. Such a material is of relatively low weight, and it offers a very high mechanical stability and loadability even with small wall thicknesses, as is known, for example, from boatbuilding. In order to further improve stability, the material may have incorporated therein additional reinforcing means, preferably in the form of metal grid or fabric (mesh).

In order to secure a secure and durable bond of the outer copper layer to the remainder of the sleeve, expediently a nickel layer of small thickness is applied to the outer surface of the center layer. This nickel layer is preferably applied by currentless nickel plating. The adjoining copper layer then may be formed e.g. galvanically.

Another preferable material for the center layer of the sleeve is a metal, mainly aluminium or steel in the present instance. Such a material permits to obtain a still higher stability and rigidity of the sleeve, accompanied, however, by a higher weight of the sleeve. The material which is actually used in each specific instance, depends on the requirements and demands imposed by the user, as well as the size of the printing cylinder.

In addition to a variation of the thickness of the inner layer of the sleeve, a variation of the thickness of the center sleeve layer also may be applied to produce different outer diameters of the sleeve with a constant core diameter. Here, the thickness of the center sleeve layer is preferably between 3 and 50 mm. This range of thicknesses permits a very wide graduation of the core diameters on the one hand, and provides for sufficient stiffness or rigidity of the sleeve on the other hand, without the weight of the sleeve becoming too high for easy handling.

For mechanical protection of the end faces of the sleeve and in order to render possible galvanic copper plating by a method similar to that used for conventional integral printing cylinders, it is contemplated that the sleeve has provided at the end faces in the vicinity of the inner and center layers, one ring each of an electroconductive material, the inner diameter of the ring being slightly larger than that of the inner layer, and its outer diameter being approximately equal to the outer diameter of the center layer. In a well-known manner, current can be conducted through these rings in the galvanizing (electroplating) process. Further, the copper layer may be applied on the end faces around the edges also to the outer surface of the rings, whereby the stability of the copper layer on the remaining portion of the sleeve and, thus, the operational life of the printing cylinder are improved.

Finally, in the printing cylinder according to the present invention, the core includes in its outer surface continuous peripheral flat grooves extended from the ends of the passages for conductiong the compressed air. This structure provides for uniform distribution of the compressed air and, thus, of the forces produced thereby, on the inner side or surface of the sleeve. In this way, any forces are avoided which act upon the sleeve and which might result in a variation from the desirable exact cylindrical configuration. Further, the number of passages or bores to be formed in the core and serving to pass the compressed air to the outer surface of the core, can be reduced with the result of a reduction of cost.

The various features of novelty which characterize the invention are pointed out with particularity in the claims annexed to and forming a part of the specification. For a better understanding of the invention, its operating advantages and specific objects obtained by its use, reference should be had to the accompanying drawing and descriptive matter in which there is illustrated and described a preferred embodiment of the invention.

BRIEF DESCRIPTION OF THE DRAWING

The FIGURE generally illustrates a cross sectional view of the cylinder of the invention.

DESCRIPTION OF A PREFERRED EMBODIMENT

As can be seen from the FIGURE, the illustrated embodiment of the rotogravure cylinder comprises substantially a core 2 and a sleeve 3 enclosing the former. The core 2 has the shape of a cylinder provided with end-side stub shafts 21 for mounting the printing cylinder for rotation in a printing operation. In the interior thereof, the core 2, otherwise formed of solid metal, generally steel, has a central air passage 22 and a plurality of air passages 23 branching from the passage 22 and extending radially outwards to the outer surface 25 of the core 2. At one end, the central air passage 22 extends continuously to the outer side and is provided with a connector 26 adjacent to the end face of the one stub shaft 21. A compressed air hose 4 is adapted to be joined to this connector 26 by means of a suitable coupling 41. The sleeve 3 comprises essentially three layers, namely an inner layer 31, a center layer 33 and an outer layer 34, which layers are each positioned in concentric relation to the axis of rotation of the printing (rotogravure) cylinder 1. The inner layer 31 of the sleeve 3 consists of an elastic (resilient) rubber material, and it has in its outer surface recesses 32 in the form of circumferentially extending grooves. On the other hand, the inner surface 36 of the inner layer 31 is formed to be smooth. In the embodiment shown, the center layer 33 consists of a rigid material, i.e. a fiberglass-reinforced plastics material in the embodiment shown. Adjoining the inner 31 and the center layer 33 at their end faces of either side is an annular metallic ring 35 each, which is bonded to the two layers 31 and 33 by means of, for example, an adhesive. In addition to serving as a mechanical protective element for the two layers 31 and 33, the rings 35 act to transmit the electric current required for the galvanic application of the outer layer 34. As is coustomary in rotogravure cylinders, the outer layer 34 comprises a copper layer. This layer is applied also to the rings 35 by extending over the edges at the end faces 34'. The copper layer forming the outer layer 34 preferably has a thickness such that the edges (or corners) at the end faces 34′ may be rounded sufficiently.

In order to render possible the galvanic copper plating, a nickel layer (not shown) may be formed between the center layer 33 and the outer layer 34.

The inner layer and the center layer 33 are preferably adhesively bonded to each other while leaving free the recesses 32.

In order to render possible the removal (withdrawal) of the sleeve 3 from the core 2 or the fitting of the sleeve 3 onto the core 2, the central air passage 22 is fed with compressed air through the hose 4, whereby the air flows to the outer surface 25 of the core 2 through the radially extending passages 23. In the region of the outer ends of the radial passages 23, the outer surface 25 of the core 2 is provided with circumferentially extending flat grooves 24 by which the compressed air is uniformly distributed over the peripheral surface of the core 2. In this way, produced between the outer surface 25 of the core 2 and the inner surface 36 of the sleeve 3 is an air cushion of a thickness sufficient to enable easy fitting on or removal of the sleeve 3. In the FIGURE, the gap between the outer surface 25 of the core 2 and the inner surface 36 of the sleeve 3 is shown on an exaggerated scale; in practice, a gap width of 0.1 mm or smaller is enough to permit the sleeve 3 to be moved with respect to the core 2 with a minimum of power. Upon removal of the pressure of the air supplied, e.g. by disconnecting the hose 4 from the hose connector 26 of the core 2, the inner surface 36 of the sleeve 3 comes into intimate contact with the outer surface of the core 2, thereby establishing a sufficiently secure and inherently stable connection between the core 2 and the sleeve 3.

The terms and expressions which have been employed are used as terms of description and not of limitation, and there is no intention in the use of such terms and expressions of excluding any equivalence of the features shown and described or portions thereof, it being recognized that various modifications are possible within the scope of the invention.

I claim:

1. A rotogravure cylinder comprising:

a substantially solid core formed of a metal with an outer surface and having passages for passing compressed air to said outer surface;

a sleeve detachably joined to the core and adapted to be fitted onto and removed from said core, said sleeve being formed of at least three concentric layers, an inner layer of a material of low elasticity, and being slightly compressible, a center layer of a rigid and inherently stable material, and an outer layer comprised of copper.

2. The cylinder of claim 1, wherein the inner layer may be varied in its thickness.

3. The cylinder of claim 1, wherein the center layer may be varied in its thickness.

4. The cylinder of claim 2, wherein the center layer may be varied in its thickness.

5. The cylinder of claim 1, wherein the sleeve is adapted to be fitted onto and removed from said core with the aid of an air cushion produced by compressed air.

6. The cylinder of claim 1, wherein the inner layer is formed of rubber.

7. The cylinder of claim 1, wherein the material of the inner layer is free from pores, and that the outer surface of the material is provided with at least one recess permitting radial expansion of the inner layer.

8. The cylinder of claim 6, wherein the rubber forming the inner layer has a Shore hardness of between 70 and 110, preferably between 85 and 90.

9. The cylinder of claim 7, wherein the recesses are formed by at least one helically extending flat groove.

10. The cylinder of claim 7, wherein at least the inner layer, including the least one recess, has been formed on a master core having a diameter of the core receiving the sleeve for the printing operation.

11. The cylinder of claim 7, wherein the inner layer has a thickness of 3 mm to 30 mm.

12. The cylinder of claim 1, wherein the center layer is formed of a fiberglass-reinforced plastics material.

13. The cylinder of claim 1, wherein the center layer includes reinforcing means, preferably of metal grid or mesh.

14. The cylinder of claim 1, wherein a nickel layer of small thickness is applied to an outer surface of the center layer.

15. The cylinder of claim 1, wherein the center layer is formed of a metal, preferably aluminum or steel.

16. The cylinder of claim 1, wherein the thickness of the center layer is 3 mm to 50 mm.

17. The cylinder of claim 1, wherein the sleeve has proximate to end faces in the vicinity of the inner and center layers, one ring each of an electroconductive material, said ring having an inner diameter slightly larger than that of the inner layer, and an outer diameter approximately equal to that of the center layer.

18. The cylinder of claim 1, wherein the core includes in its outer surface at least one continuous peripheral flat groove extending from the ends of the passages.

* * * * *